United States Patent [19]

Fock et al.

[11] 4,151,315

[45] Apr. 24, 1979

[54] MANUFACTURE OF COATED SPLIT-RESISTANT IMPROVEMENT WEBS FROM PAPER HAVING UNIT WEIGHT 60 g/m²

[75] Inventors: Jürgen Fock, Düsseldorf; Helmut Bühler, Essen, both of Fed. Rep. of Germany

[73] Assignee: Th. Goldschmidt AG, Essen, Fed. Rep. of Germany

[21] Appl. No.: 915,752

[22] Filed: Jun. 15, 1978

[30] Foreign Application Priority Data

Jun. 16, 1977 [DE] Fed. Rep. of Germany ..... 2727312

[51] Int. Cl.² ..... B05D 1/38; B05D 3/02

[52] U.S. Cl. ..... 427/258; 156/277; 427/288; 428/203; 428/219

[58] Field of Search ..... 427/258, 288; 428/203, 428/342, 219, 220, 530, 531; 156/277

[56] References Cited

U.S. PATENT DOCUMENTS

| | | | |
|---|---|---|---|
| 1,634,830 | 7/1927 | Hargrave | 156/277 |
| 2,380,047 | 7/1945 | Hyman | 427/288 X |
| 2,668,124 | 2/1954 | Mallabar | 427/258 |
| 3,654,044 | 4/1972 | Hirota | 428/203 X |

FOREIGN PATENT DOCUMENTS

| | | | |
|---|---|---|---|
| 850948 | 10/1960 | United Kingdom | 427/288 |

*Primary Examiner*—Evan K. Lawrence

*Attorney, Agent, or Firm*—Toren, McGeady and Stanger

[57] ABSTRACT

A method for manufacturing split-resistant improvement webs from paper having a weight per unit area of ≦60 g/m² which has a hardened synthetic resin on the decorative side and which are used for gluing to the surface of wood-based panels wherein a solution or dispersion of a hardenable impregnating resin is first applied to the paper using a metered-roller application in an amount between about 8% based on the solids content of the resin (of the weight of the paper) but less than an amount such as to assure that the resin does not penetrate to the reverse side of the paper. The impregnated paper is then dried, decoratively printed, and then coated with a solution or dispersion of a hardenable resin followed by drying and hardening. Such webs are easily handled and can be rolled up and the method allows the use of conventional paper which does not have to be specially treated.

5 Claims, No Drawings

MANUFACTURE OF COATED SPLIT-RESISTANT IMPROVEMENT WEBS FROM PAPER HAVING UNIT WEIGHT 60 G/M²

BACKGROUND OF THE INVENTION

1. Field of the Invention

The invention relates to a process for the manufacture of split-resistant improvement webs which are made from paper with a weight per unit area of ≦60 g/m² which have a hardened synthetic resin on the decorative side and are glued on the surface of wood-based panels to provide a decorative and/or protective surface therefor.

2. Description of the Prior Art

It has long been known as described in German Pat. No. 1,053,303, that paper webs may be impregnated with a solution of a hardenable synthetic resin and, after an optionally interposed drying step, coated with a solution of a hardenable synthetic resin. It is noted, in this regard, that as used herein and as is understood in this art, the term coating or coated means that the particular resin applied does not significantly penetrate into or impregnate the paper.

The products obtained from this process are pressed onto the surface of wood-based panels under conditions appropriate for hardening the resin. For this purpose, paper with a weight per unit area of 60–200 g/m² is generally used.

When this type of surface improvement method is used, the processor requires a hotpress, whose pressure is sufficiently high such that at the elevated temperatures of the hardening step, a continuous film is formed of the synthetic resin which is in a molten state and which reproduces the surface structure of the platen. For this purpose, pressures of about 20 kg/cm² are required.

It is also well known that improvement webs having such synthetic resin may be hardened, without pressure during their manufacture. These carrier webs, containing hardened synthetic resin are glued by the processor to the surface of wood-based panels and are sometimes optionally provided with an additional, subsequent lacquer application. Pressures of 3–5 kg/cm² are adequate for the gluing step.

Synthetic resin containing carrier webs and especially those with the additional lacquer application have the disadvantage that they are very brittle because there are relatively large portions of resin in and on the carrier webs. As a result of the brittleness, tears, eruptions and slits in the web may occur during the manufacture and/or processing of the webs and these defects may lead to breakdowns and losses. Although the carrier webs are manufactured in rolls, because of their fragility and brittleness, they are generally supplied to the press in sheet form for further processing. Further processing of these carrier webs on presses fed from rolls is difficult or impossible because of the fragility, sensitivity and brittleness of the material.

As disclosed in German Auslegeschrift No. 1,287,040, it is known that a crude paper with a specific weight of 1 g/cm³ and a porosity of not more than 100 ml/minute may be used for impregnating by known procedures with hardenable aminoplast resins or their precondensates, dissolved in organic solvents, for the purpose of manufacturing plastic veneers. The resin portion does not amount to more than 25–30% of the weight of the paper. While these products are more flexible and elastic than the carrier webs, the high density of the paper always makes the use of resins dissolved in organic solvents necessary.

More recently, improvement webs have also become known which have a hardened synthetic resin and are based on thin paper with a weight per unit area of ≦60 g/m². Because of their lesser paper weight, these paper webs are less expensive. After they are printed, such papers are first provided with a coating resin. In this state, they are not brittle and are thus well suited for processing on presses which are fed from a roll.

However, if such coated carrier webs are glued to wood-based panels, it turns out that the split-resistance of the improvement layer is inadequate. If, for example, an adhesive strip is glued to the surface of a wood-based panel improved with such a product, and if this strip is then torn from the surface, the improvement layer splits within the plane of the paper. At times, the resin layer may also strip from the paper support.

On the other hand, if this type of supporting web with a low paper weight is impregnated by conventional procedures and is subsequently coated and optionally hardened before or during the coating, the same problems of brittleness of the improvement web occur as occur with improvement webs whose supporting webs have a higher paper weight.

German Auslegeschrift No. 21 41 703 describes a decorative paper characterized by the fact that the base paper is a highly densified, reinforced, parchment-like cellulose paper, kept free of pigment in the paper mass and having a weight per unit area of much less than 50 g/m². A higher resistance to splitting is obtained with such a paper, although at the expense of having to use a highly densified, parchment-like paper which must be free of pigment. The parchmentizing represents an additional expensive processing step in the manufacture of paper. Moreover, since the paper must be pigment-free, the basic color of the decorative paper must be applied in an additional printing process.

A resin-impregnated thin paper has also already been prepared by adding synthetic resin to the fiber slurry during the manufacture of the paper. Such papers either are brittle and difficult to handle or they do not have the necessary resistance to splitting. Also, they frequently are porous so that, as the film manufactured from them is glued onto wood-based panels, glue penetrates through the pores and forms spots on the surface of the improved panels.

SUMMARY OF THE INVENTION

We have discovered a method for preparing improvement webs which contain a hardened synthetic resin, are based on paper with a weight per unit area of ≦60 g/m² and, while being easily handled and capable of being rolled up, produce split-resistant surface coatings on wood-based panels. Such improvement webs are obtained using conventional paper of the aforementioned weight per unit area without special treatment, such as, for example, parchmentizing.

More particularly, the present invention comprises first applying to the side of the paper intended for the decorative print a solution or dispersion of a hardenable impregnating resin by a metered-roller application in amount of at least 8% (based on the solids content of the resin) of the weight of the paper and, at most, in an amount such that the resin does not penetrate to the reverse side of the paper. The impregnated paper is dried and the dried paper decoratively printed and the impregnated and printed paper is subsequently coated with the solution or dispersion of a hardenable resin which is then dried and hardened. Prior to the coating, if desired, an intermediate layer may be applied.

DESCRIPTION OF THE PREFERRED EMBODIMENT

More particularly, in the present invention, an impregnating resin is applied to that side of the paper web which is printed on later and thereafter, the product of the process is printed on.

A further characteristic of the inventive process consists in the metering of the resin onto the web by a roller application. This metered-roller application of the hardenable impregnating resin is achieved with conventional equipment with which a prescribed amount of resin is transferred by a roller to one side of the paper web. This takes place preferably by means of the printing mechanism of a printing machine.

Using the well-known rotogravure process, either the direct or indirect method of printing may be used. The patterned roller is wiped and the accurately metered amount of synthetic resin is transferred directly or indirectly onto the paper web. The flexographic process may also be used. In this process, the paper web is fed between a metal roller and a rubber roller, the rubber roller transferring the metered amount of resin by means of the coating mechanism to the paper web.

The amount of hardenable impregnating resin applied onto the web must lie within the following limits. The minimum amount of hardenable synthetic resin is 8% of the weight of the paper (based on the solids content of the resin). This means that, for example, in the case of a paper web with a weight per unit area of 40 g/m$^2$, at least 3.2 g/m$^2$ of solid resin must be applied. If this amount is not used, the adhesion of the product to the wood-based panel is either not split-resistant or is insufficiently split-resistant.

The upper limit for the amount of resin is determined by the fact that the resin may not penetrate through to the reverse side of the paper in order to avoid adhesion of the paper web which is to be coated with resin, to the paper guide rolls of the printing machine. Moreover, in order to ensure that the product produced by the present process can be glued with the adhesive to the surface of the wood-based panel, the reverse side of the paper should remain in the fibrous condition. The penetration of the resin can be avoided, if the resin application is less than 35% based on the weight of the paper. In addition, the flexibility required can be maintained.

After the dispersion or the solution of the hardenable synthetic resin has been applied, the paper web is dried. In so doing, the applied impregnating resin may already be hardened completely or partially. Preferably, however, it is hardened only slightly.

The decorative print is now applied by known procedures to the side of the paper containing the impregnating resin. It has proven to be particularly advantageous to carry out the impregnating process and subsequently the design printing process on one and the same printing machine in a single operating step. By so doing, high production speeds are attained with minimal waste and expenditure of labor.

The impregnated and printed process product so obtained is now coated by conventional procedures, optionally after applying an intermediate layer, with a hardenable resin which is then hardened together with the impregnating resin.

The invention thus resides particularly in the sequence of process steps and is supplemented by specifying the amounts of synthetic resins to be used for the impregnation.

It was surprising that the process product exhibits good split-resistance even at the slight resin take-up of 8% of the weight of the paper. Moreover, it could not have been anticipated that the image, printed on the paper web which had been impregnated with so little resin, would retain its sharp outlines during the design printing process as well as during the pressing process.

German Auslegeschrift No. 11 87 120 teaches how a paper may be impregnated on one side with a polyester resin in such a manner that this resin does not penetrate to the reverse side and that, simultaneously or subsequently, the paper is impregnated on the reverse side with an aminoplast resin. However, it is difficult to print on such products after they have been impregnated with polyester resin. Moreover, it has been established that these products split particularly readily at the boundary layer which is formed by impregnating one side of the paper with the polyester resin and the other side with an aminoplast resin, provided that the resins are hardened without pressure. Because of their brittleness, they are difficult to handle, especially when paper webs weighing $\leqq 60$ g/m$^2$ are used for their manufacture.

The selection of the type of hardenable synthetic resin, the printing inks, the nature of the coating resin, and optionally, of the intermediate layer, depends on considerations familiar to those skilled in the art. It is obvious that the resins must be compatible with one another and with the printing inks since, in the case of incompatibility, splits in the carrier web as well as optical impairment would once again be observed.

As impregnating resins, aqueous solutions of condensation resins or aqueous solutions or dispersions of polymerization resins, i.e., resins from vinyl monomers, e.g., acrylic resins, are used. As condensation resins, particularly the condensation products of formaldehyde with urea and melamine may be used. Other materials, which form aminoplast resins, such as, thiourea, may be cocondensed. The urea-formaldehyde or melamine-formaldehyde resins may be etherified, i.e., the hydroxyl groups of the methylol groups may be reacted with a lower alcohol. The number of carbon atoms in the lower alcohols is preferably 1 to 4. It is also possible to combine alkyd resins, for example, those based on phthalic acid and glycerol, with the aminoplast resin.

As acrylic or polymerization resins, those resins may be used which are known from the state of the art and which are self-crosslinking as a result of the incorporation of self-crosslinking monomers or which, in the absence of such groups, can be crosslinked by the addition of crosslinking agents.

Hardening catalysts are added to the condensation resins. In the case of condensation resins especially, it turns out that the water resistance and the flatness of the improvement webs can be increased by adding a relatively high amount of hardening catalyst, i.e., up to 4 weight % based on the solids content of the resin.

The printing ink or binder for the printing ink is selected depending on the choice of the impregnating resin. For example, when using an aminoplast resin as the impregnating resin, printing inks based on chloroprene rubber, partially saponified polyvinyl acetates and polyvinyl alcohols may be used.

As printing ink binders, partially hardened polymerization resins, such as, for example, crosslinkable acrylic resins or alkyd resins are suitable. Other suitable binders are those based on protein, such as, casein, or those based on starch, such as, dextrin or methyl cellulose.

The choice of the coating resin is determined especially by the surface property desired in the improved wood-based panels. The coating resins determine the chemical and physical behavior of the panel, for example, the gloss, the hardness, the behavior towards solvents, acids and alkalis and the ability to lacquer the improved surface as well as to stack the improved wood-based panels while hot.

As coating resins, aminoplasts lacquer resins or lacquers dissolved in organic solvents, for example, nitrocellulose lacquers, which are known for this application, may be used.

Optionally, an intermediate layer may be provided between the impregnating resin and the coating resin. The intermediate layer may consist of the aqueous dispersion of a polymerization, i.e., acrylic, resin. Its function is to achieve a uniformly level layer of coating resin.

The products obtained with the present process are glued with known glues to the surface of the wood-based panels. For this purpose, urea glues, in the form of aqueous solutions, are particularly suitable. A covering pigment, e.g., $TiO_2$, may be added to these glues in order to increase the covering power of the coating. Such a procedure compensates for the lesser covering power of the thin paper with the relatively low weight per unit area which is used.

The inventive process is described in greater detail by means of the following examples.

EXAMPLE 1

A 50% aqueous solution of a urea-formaldehyde resin, to which 3% of ammonium chloride has been added as a catalyst is applied on the upper side of a smooth, filled, unprinted decoration paper, with a weight per unit area of 40 g/m$^2$, a density of 0.78 g/cm$^3$, an air permeability of 700 ml/minute, as ash content of 10% and a resin content of 95%, with a patterned roller with 50 lines/cm in a printing mechanism at a web speed of 60 m/minute. After complete drying, the amount of resin, impregnated in this manner, is 6 g/m$^2$. After impregnating, the moist film web is dried in such a manner, that the resin does not harden or hardens only partially.

In the same operating step, the same upper side is printed with a design in two printing mechanisms. The printing ink includes casein as a binder.

After printing the design, a 50% aqueous dispersion of an acrylate resin is applied to the same side at a rate of 6 g/m$^2$ (based on the solids content) with a patterned roller having 40 lines/cm in order to form a barrier layer.

In the last step of the process, the web is coated with a mixture of nitrocellulose and an acid hardenable, etherified urea resin in an organic solvent at the rate of 1 g/m$^2$ (based on the solids content).

The product obtained in this manner is hardened at 160° C. for 30 seconds.

After the hardening step, the film obtained has an overall weight of 52 g/m$^2$. It has high flexibility and cannot be split by attaching an adhesive tape to the design side.

Using a urea-formaldehyde resin, pigmented with a white pigment, as adhesive, the film is glued to a chipboard at a temperature of 135° C. and a pressure of 5 kg/cm$^2$ for 45 seconds.

The surface improvement layer adhered firmly and proved to be split-resistant. It exhibited a uniform gloss with no glue penetration. The surface is scratch-resistant. In the case of damage by scratching, it may be lacquered over with lacquers conventionally used for this purpose.

EXAMPLE 2

(Comparison, not in accordance with the invention)

The procedure is identical with that in Example 1 with the exception that the design printing process is carried out before impregnating with the patterned roller.

A film results which, after pressing, easily splits at those sites at which there is design printing ink.

EXAMPLE 3

(Comparison, not in accordance with the invention)

The procedure is identical with that in Example 1 with the exception that, in the impregnating process, solid resin in the amount of 30 g/m$^2$ is applied by repeated applications of the patterned roller. In this case, the impregnating resin penetrates to the reverse side of the paper. After a very mild drying, the film adheres to the printing roller. With more severe drying on the other hand, there are frequent tears in the film web because of the brittleness of the product.

Although a film produced in this manner is split-resistant, after three months of storage and pressing with urea resin, it inadequately adhered to the laminated chipboard.

What is claimed is:

1. In a method for the manufacture of split-resistant improvement webs wherein a thin paper having a weight per unit area of $\leqq 60$ g/m$^2$ is coated with a hardenable synthetic resin after decorative printing, dried, and hardened, the improvement which comprises, prior to decorative printing, applying a solution or dispersion of a hardenable impregnating resin to the side of the paper to be decorated using a metered roller application, the amount of said impregnating resin being between at least about 8% of the weight of the paper based on the solids content of the resin, and that amount of resin to assure that the resin does not penetrate through to the reverse side of the paper, and then drying the impregnated paper.

2. The process of claim 1 wherein after the decorative printing and prior to coating with the hardenable resin, an intermediate layer is applied to the paper.

3. The process of claim 1 wherein the impregnating resin is applied by means of the printing mechanism of a printing machine.

4. The process of claim 3 wherein the impregnating process and the subsequent decorative print process are carried out in the printing machine in one operating step.

5. The process of claim 1 wherein an aqueous solution of an aminoplast resin is used as an impregnating resin.

* * * * *